United States Patent [19]

Kania

[11] Patent Number: 4,631,774

[45] Date of Patent: Dec. 30, 1986

[54] DUST COLLECTING APPARATUS

[76] Inventor: Alice M. Kania, 3901 W. 56th Pl., Chicago, Ill. 60629

[21] Appl. No.: 692,557

[22] Filed: Jan. 18, 1985

[51] Int. Cl.[4] ..... A47L 13/52

[52] U.S. Cl. ..... 15/257.1

[58] Field of Search ..... 15/104.8, 257.1, 257.2, 15/257.3, 257.4, 257.7, 257.8, 257.9; D32/74

[56] References Cited

U.S. PATENT DOCUMENTS

| | | | |
|---|---|---|---|
| D. 16,974 | 11/1886 | Palmer . | |
| D. 54,891 | 4/1920 | Brulé . | |
| D. 94,592 | 2/1935 | Badger . | |
| D. 267,592 | 1/1983 | Payne, Jr. et al. . | |
| 615,565 | 12/1898 | Marsh | 15/257.7 |
| 2,255,715 | 9/1941 | Samms . | |
| 2,651,924 | 9/1953 | Lawrence . | |
| 2,812,784 | 11/1957 | Palmer . | |
| 2,987,749 | 6/1961 | Gortner | 15/257.7 |
| 3,002,209 | 10/1961 | McKinistry | 15/257.1 X |
| 3,382,523 | 5/1968 | Parsisson | 15/257.2 |
| 3,639,937 | 2/1972 | Sweeney | 15/257.1 X |
| 4,344,648 | 8/1982 | Mapp | 15/257.1 X |

*Primary Examiner*—Chris K. Moore

*Attorney, Agent, or Firm*—Wood, Dalton, Phillips, Mason & Rowe

[57] ABSTRACT

The present invention is an improvement in a dust collecting apparatus of the type having a dust receiving pan with a flat bottom wall, a straight lip at a leading portion of the bottom wall and a dust containing wall extending upwardly from the bottom wall. According to the invention, spaced, side wall portions of the dust containing wall have support edges substantially perpendicular to the bottom wall and residing in a single plane with the lip. The side wall portions have free upper edges at right angles to the support edges.

3 Claims, 2 Drawing Figures

DUST COLLECTING APPARATUS

BACKGROUND OF THE INVENTION

1. Field of the Invention

This invention relates to dust collecting apparatus and, more particularly, to a dust collecting apparatus that is self supporting in a storage position.

2. Background Art

Dust collecting apparatus, generally identified as dust pans, are normally designed with aesthetics taking precedence over utility. For example, U.S. Design Pat. No. 54,891, to Brule, discloses a dust pan with a flat bottom wall and a dust retaining wall extending upwardly from and bounding three sides of the flat bottom wall. The spaced, side wall portions of the dust retaining walls increase progressively in height from a leading portion of the bottom wall, whereat a lip is formed, towards a rear wall portion which carries a handle intermediate its height.

The most convenient manner of storing the dust pan is to lean the dust pan upon the lip so that the flat bottom wall is oriented substantially vertically. However, because the Brule structure is not self supporting, a vertical abutment such as a wall is required against which the rear wall can be leaned. For reasons of stability, the lip is normally placed a distance away from the abutment before the dust pan is leaned. In the case of the Brule dust pan, the angle of inclination of the bottom wall may be such that the handle abuts the wall before the upper, free edge of the rear wall. This may keep the dust pan precariously situated.

The location of the handle on the Brule dust pan also complicates hanging storage. Normally, a wall hanger is directed through the ring at the end of the handle. Because the ring is offset vertically with respect to the flat bottom wall from the upper edge of the rear wall, an undesirably long hanger may be required to engage the ring and at the same time allow the upper edge of the rear wall to abut the supporting wall. In the event that too short a hanger is used, the pan will tend to pivot so that the ring pulls away from the hanger.

A still further drawback with the Brule dust pan is that the sloping side walls limit the dust containing capacity. A substantial amount of useable storage space is eliminated primarily in the interest of improving the aesthetics of the dust pan.

SUMMARY OF THE INVENTION

The present invention is specifically directed to overcoming the above enumerated deficiencies known in the art in a novel and simple manner.

The present invention is an improvement in a dust collecting apparatus of the type having a dust receiving pan with a flat bottom wall, a straight lip at a leading portion of the bottom wall and a dust containing wall extending upwardly from the bottom wall. According to the invention, spaced, side wall portions of the dust containing wall have support edges substantially perpendicular to the bottom wall and residing in a single plane with the lip. The side wall portions have free upper edges at right angles to the support edges.

It is a principal objective of the present invention to provide a dust collecting apparatus that is simple and practical as well as hangable, standable, washable and unbreakable.

It is a more specific objective of the present invention to provide a dust collecting apparatus that is standable or self supporting in a storage position. The support edges and lip can be placed on a flat floor surface and will maintain the pan bottom wall oriented substantially vertically. The upper free edges of the side walls can be presented squarely to a wall surface so that the dust collecting apparatus can be conveniently and compactly stored without leaning the apparatus against the wall.

By reason of the construction of the side wall portions and the relationship between the side wall portions and the flat bottom wall, the storage capacity of the dust pan is optimized.

Another aspect of the invention is the provision of a handle comprising a flap situated in the plane of the free upper edges of the side walls. A hole can be provided in the handle through which a hanger extends to support the dust collecting apparatus. Because the flat upper edges of the side walls reside in a single plane, and closely against a supporting wall, the extension of the hanger from the supporting wall can be minimal.

Another advantage of the invention according to the above construction is that the dust collecting apparatus is capable of manufacture by a stamping operation from a single sheet of material. The use of thin, sheet metal aluminum is specifically contemplated.

DETAILED DESCRIPTION OF THE INVENTION

Figure 1:
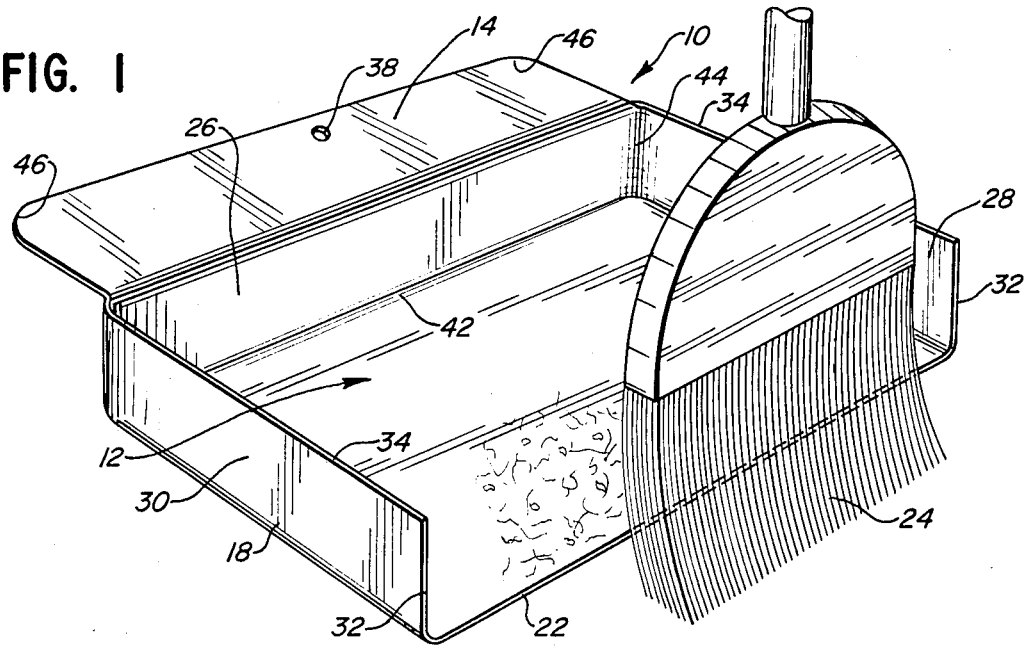
FIG. 1 is a perspective view of a dust collecting apparatus according to the present invention situated for use with a broom.
Figure 2:
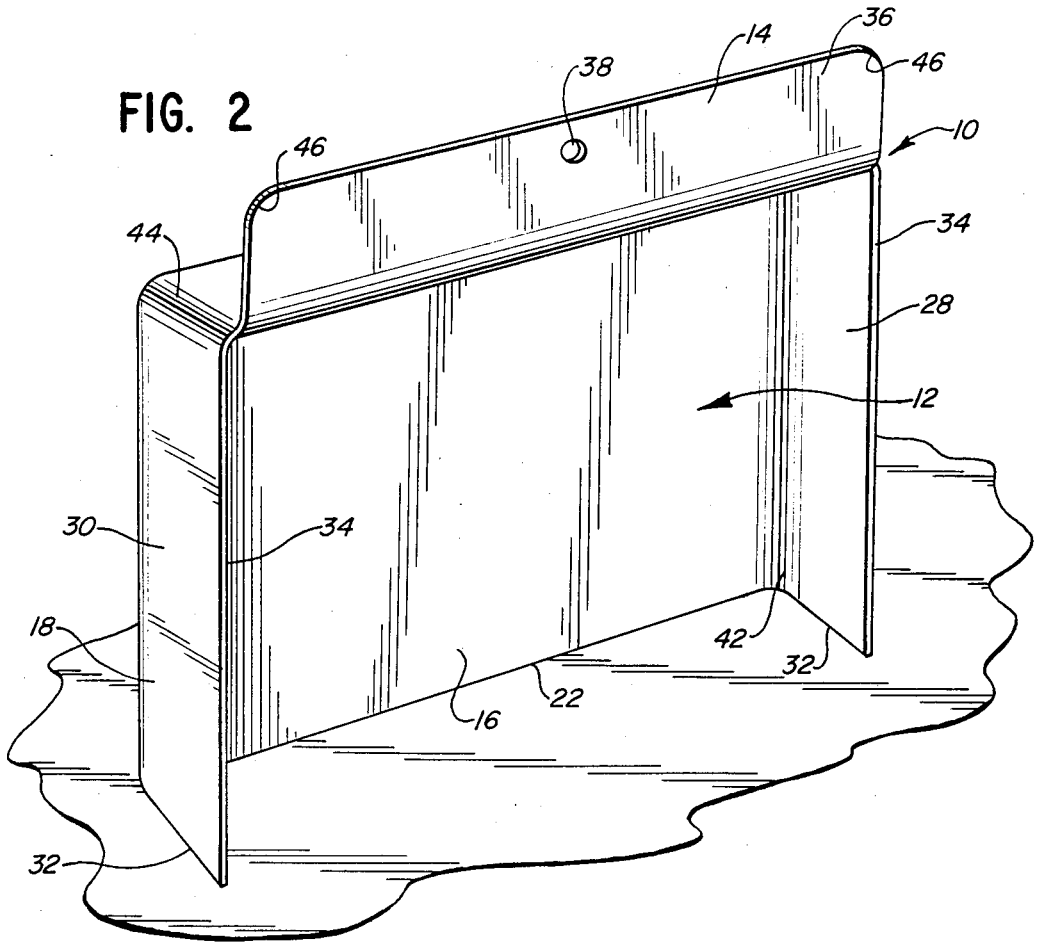
FIG. 2 is a perspective view of the dust pan of FIG. 1 in a self-standing, storage position.

As depicted in FIG. 1 and 2, the dust collecting apparatus at 10, according to the present invention, comprises a dust receiving pan at 12 and an integral handle 14 to facilitate manuevering of the pan 12.

The dust receiving pan 12 comprises a substantially flat, rectangular, bottom wall 16 and a three-sided dust containing wall 18 extending upwardly from the bottom wall 16 and continuously about three sides of the wall 16. The leading portion 20 of the wall 18 is open to allow the admission of dust into the pan 12.

In operation, the bottom wall 16 is placed substantially facially against a flat surface bearing the matter to be collected. The wall 16 has a straight lip or dustreceiving edge 22 which resides closely against the flat surface from which the matter is to be removed. The matter is directed over the lip 22 and onto the wall 16 within the confines of the three-sided wall 18 manually by a broom 24 or the like and directed towards the intermediate side or rear wall portion 26 to allow progressive accumulation of matter within the pan 12.

According to the invention, the three-sided wall 18 has two spaced, side wall portions 28,30 each having a support edge 32 and upper free edge 34 at a right angle to the support edge 32. The support edges 32 reside in a common plane with the lip 22 at right angles to the plane of the bottom wall 16. The dust collecting apparatus 10 is positionable in a storage position by placing the lip 22 and support edges 32 against a flat surface. Preferably, the height of the side wall portions 28, 30 is on the order of two inches so that the dust collecting apparatus will be stable in the storage position as shown in FIG. 2.

With the dust collecting apparatus 10 in the FIG. 2 position, the upper free edges 34 of the side wall portions 28, 30 can be presented squarely at an upright wall in a room or closet. By making the height of the side wall portions 28,30 uniform, the capacity of the pan 12 is optimized and, at the same time, aligns closely with an upright wall in a room or closet to facilitate compact storage of the apparatus 10. Because the apparatus 10 is self-supporting, the edges 34 do not have to be leaned against the wall under the weight of the apparatus 10. Because the apparatus 10 is not leaned against the wall, there is no tendency of the apparatus to scratch, make marks, or distribute dirt on the wall surface. The self-supporting capability is desirable further in that with a smooth, floor surface, the lip of a conventional dust pan tends to slide along the floor surface when it is attempted to lean the dust pan against a wall in the storage position.

It is another aspect of the invention to form the handle 14 as a flat flap 36 that is bent out of the rear wall portion 26 to reside in the plane of the edges 34. This is particularly desirable where the apparatus is suspended from a hanger. To facilitate hanging, a hole 38 is provided in the flap 36 to accept a hanger. A relatively short hanger will accommodate the apparatus constructed as shown and described herein. The upper surface 40 of the flap 36 facially abuts a wall upon which the hanger is carried at the same time the edges 34 are squarely presented at the vertical wall.

In one preferred form of the invention, the apparatus 10 is manufactured by a stamping operation from a single sheet of aluminum, such as polished aluminum, on the order of 20 gauge thickness. The sheet, for example, may be 12" by 16", which after stamping has the edges, i.e. edges 32 and 34, smoothed or rounded to avoid any sharp burrs or the like on the edges. Preferably, the flat bottom wall 16 can be tapered along the last half inch or so as it approaches the lip 22 to provide a ramp to facilitate entry of fine particles into the pan 12. The 12" by 16" sheet is stamped into an assembly with the side walls 26,28,30 being 2" high and with the bottom wall 16 being 12" wide and 8" deep. The handle 14 is 2" from front to rear and has rounded corners 46. The overall structure is very light in weight and readily manageable by grasping the handle 14, which conveniently extends along the entire distance between the side wall portions 28,30.

For ease of cleaning and fabrication, the corners 42 at the juncture between the dust containing wall 18 and the flat bottom wall 16 are rounded. This prevents the accumulation of matter in hard to reach, tight corners. For the same reasons, the corners 44 defined between the side wall portions and the rear wall portion are curved.

The resulting structure is simple, practical and capable of inexpensive fabrication. The apparatus is easily maneuverable, is hangable, standable, washable and unbreakable. The apparatus has substantial dust containing capacity and is readily and conveniently stored either by hanging or by situation on a flat floor surface in self-supporting fashion.

The foregoing detailed description was made for purposes of demonstrating the structure and operation of the invention, with no unnecessary limitations to be understood therefrom.

I claim:

1. An improved one-piece dust collecting apparatus of the type having a dust receiving pan with a flat bottom wall lying substantially in a first plane, a front substantially straight lip at a leading edge portion of the bottom weall and a dust-containing wall extending upwardly from the flat bottom wall and having first and second flat spaced side wall portions, each side wall portion having a free outer edge and a front edge and a handle associated with the pan to maneuver the pan, the improvement comprising:

said dust-containing wall extending transverse to and continuously around the bottom wall at all but the leading edge portion thereof;

said handle including a portion of said dust-containing wall and having a flat upper surface extending transverse to said portion of the dust-containing wall;

said front edges of the side walls and the front substantially straight lip residing substantially in a second plane transverse to the first plane containing the bottom wall, said dust-collecting apparatus being open and unobstructed above the bottom wall and within the confines of the dust-containing wall, and said outer edges of the side wall portions residing substantially within a third plane at right angles to the second plane and in coplanar relationship with the flat upper surface of the handle, said flat upper surface having a hanging aperture therethrough along the centerline of the dust collecting apparatus, whereby the dust-collecting apparatus not only is self-standing by situation the front edges of the side wall portions and the lip of the bottom wall directly on a flat surface but also is stored flush against a wall surface by passing a hanger through the aperture in the flat upper surface with the outer edges and the flat upper surface of the handle presented flush to an upright wall surface.

2. The improved dust collecting apparatus of claim 1 wherein the dust collecting apparatus is formed by stamping from a single piece of deformable metal.

3. The imrpoved dust-collecting apparatus of claim 2 wherein the metal from which the dust-collecting apparatus is formed is aluminum.

* * * * *